US008305319B2

(12) United States Patent
Chang et al.

(10) Patent No.: US 8,305,319 B2
(45) Date of Patent: Nov. 6, 2012

(54) LIQUID CRYSTAL DISPLAY DEVICE HAVING LOOK UP TABLE FOR ADJUSTING COMMON VOLTAGES AND DRIVING METHOD THEREOF

(75) Inventors: Chih-Sheng Chang, Miao-Li (TW); Chao-Yi Hung, Miao-Li (TW); Sz-Hsiao Chen, Miao-Li (TW); Sheng-Tien Cho, Miao-Li (TW); Chueh-Ju Chen, Miao-Li (TW); Tsau-Hua Hsieh, Miao-Li (TW); Chiu-Lien Yang, Miao-Li (TW)

(73) Assignee: Chimei InnoLux Corporation, Miaoli County (TW)

( * ) Notice: Subject to any disclaimer, the term of this patent is extended or adjusted under 35 U.S.C. 154(b) by 762 days.

(21) Appl. No.: 12/383,873

(22) Filed: Mar. 30, 2009

(65) Prior Publication Data

US 2009/0243987 A1 Oct. 1, 2009

(30) Foreign Application Priority Data

Mar. 28, 2008 (CN) ..... 2008 1 0066350

(51) Int. Cl.
*G09G 3/36* (2006.01)

(52) U.S. Cl. ..... 345/94; 345/87; 345/96; 345/97; 345/100; 345/102

(58) Field of Classification Search ..... 345/54, 345/75.2–102, 208–213, 467, 204, 690; 359/630, 359/290; 358/520; 348/254, 674
See application file for complete search history.

(56) References Cited

U.S. PATENT DOCUMENTS

| | | | | |
|---|---|---|---|---|
| 4,964,699 | A * | 10/1990 | Inoue | 345/98 |
| 5,194,945 | A * | 3/1993 | Kadowaki et al. | 358/520 |
| 5,485,173 | A * | 1/1996 | Scheffer et al. | 345/100 |
| 5,561,440 | A * | 10/1996 | Kitajima et al. | 345/87 |
| 5,675,356 | A * | 10/1997 | Ooki et al. | 345/101 |
| 6,064,358 | A * | 5/2000 | Kitajima et al. | 345/88 |
| 6,331,845 | B1 * | 12/2001 | Kitajima et al. | 345/88 |
| 6,335,717 | B2 * | 1/2002 | Hasegawa et al. | 345/97 |
| 6,801,293 | B1 * | 10/2004 | Nishiyama et al. | 349/187 |
| 6,989,808 | B2 * | 1/2006 | Hanaoka et al. | 345/89 |
| 7,102,604 | B2 | 9/2006 | Hong | |
| 7,221,348 | B2 * | 5/2007 | Ogawa | 345/89 |
| 7,391,427 | B2 * | 6/2008 | LeBlanc | 347/188 |

(Continued)

FOREIGN PATENT DOCUMENTS

CN 101542581 A 9/2009

*Primary Examiner* — Prabodh M Dharia
(74) *Attorney, Agent, or Firm* — Li & Cai Intellectual Property (USA) Office

(57) ABSTRACT

A liquid crystal display (LCD) device includes an LCD panel, and a common voltage generating circuit configured for providing common voltages to the LCD panel. The common voltage generating circuit includes a microprocessor, a timer, a voltage adjustment circuit, and a look up table. The microprocessor is electrically connected to the timer, the look up table, and the voltage adjustment circuit. The timer is configured for recording a continuous operated time of the LCD panel. The look up table is configured for storing optimal common voltages corresponding to each continuous operated time. The microprocessor is configured for reading the optimal common voltage at set intervals corresponding to the continuous operated time, and controlling the voltage adjustment circuit to provide the corresponding optimal common voltage to the LCD panel.

12 Claims, 2 Drawing Sheets

U.S. PATENT DOCUMENTS

| | | | | |
|---|---|---|---|---|
| 7,667,679 | B2 * | 2/2010 | Park et al. | 345/89 |
| 7,893,907 | B2 * | 2/2011 | Kang | 345/94 |
| 7,893,908 | B2 * | 2/2011 | Morimoto et al. | 345/94 |
| 8,094,143 | B2 * | 1/2012 | Kamada et al. | 345/204 |
| 8,098,221 | B2 * | 1/2012 | Song et al. | 345/94 |
| 8,125,433 | B2 * | 2/2012 | Song et al. | 345/95 |
| 2001/0011979 | A1 * | 8/2001 | Hasegawa et al. | 345/87 |
| 2003/0058543 | A1 * | 3/2003 | Sheedy et al. | 359/630 |
| 2004/0207901 | A1 * | 10/2004 | Kaneko | 359/290 |
| 2004/0239668 | A1 * | 12/2004 | Morosawa et al. | 345/212 |
| 2004/0239698 | A1 * | 12/2004 | Kamada et al. | 345/714 |
| 2005/0007326 | A1 * | 1/2005 | Kudo et al. | 345/87 |
| 2006/0044242 | A1 * | 3/2006 | Park et al. | 345/89 |
| 2007/0146260 | A1 | 6/2007 | Kang | |
| 2007/0216623 | A1 * | 9/2007 | Kimura | 345/89 |
| 2008/0027509 | A1 * | 1/2008 | Andino et al. | 607/50 |
| 2008/0074410 | A1 * | 3/2008 | Kim et al. | 345/211 |
| 2008/0170020 | A1 * | 7/2008 | Kim et al. | 345/89 |
| 2008/0224986 | A1 * | 9/2008 | Huang et al. | 345/102 |
| 2009/0284456 | A1 * | 11/2009 | Song et al. | 345/94 |
| 2009/0315872 | A1 | 12/2009 | Ikeda et al. | |
| 2010/0090938 | A1 * | 4/2010 | Kamada et al. | 345/92 |
| 2010/0103206 | A1 * | 4/2010 | Kamada et al. | 345/690 |

* cited by examiner

LIQUID CRYSTAL DISPLAY DEVICE HAVING LOOK UP TABLE FOR ADJUSTING COMMON VOLTAGES AND DRIVING METHOD THEREOF

BACKGROUND

1. Technical Field

The present disclosure relates to liquid crystal display devices (LCDs) and methods for driving the LCD devices, and particularly to an LCD device having a look up table for adjusting common voltages and a method for driving the same.

2. Description of Related Art

Because LCDs have the advantages of portability, low power consumption, and low radiation, they have been widely used in various portable information products such as notebooks, personal digital assistants (PDAs), video cameras, and the like.

Referring to FIG. 4, a typical LCD 10 includes an LCD panel 11. The LCD panel 11 includes a pixel electrode 112, a common electrode 111, a liquid crystal layer 113, an upper polarizer 114, and a lower polarizer 115. The upper polarizer 114 is disposed opposite to the lower polarizer 115, and a polarizing axis of the upper polarizer 114 is perpendicular to that of the lower polarizer 115. The liquid crystal layer 113 is sandwiched between the upper polarizer 114 and the lower polarizer 115. The pixel electrode 112 is disposed between the liquid crystal layer 113 and the lower polarizer 115. The common electrode 111 is disposed between the upper polarizer 114 and the liquid crystal layer 113. The common electrode 111 and the pixel electrode 112 are made from transparent material such as indium tin oxide (ITO) or indium zinc oxide (IZO).

A gray level voltage is applied to the pixel electrode 112, and a common voltage is applied to the common electrode 111, thereby a voltage difference is formed between the pixel electrode 112 and the common electrode 111. The voltage difference generates an electric field to control rotations of liquid crystal molecules of the liquid crystal layer 113. Thus, a volume of light transmittance is controlled to display images by the liquid crystal layer 113 together with the upper polarizer 114 and the lower polarizer 115.

The common voltage is generally a constant voltage. However, on one hand, a temperature of the LCD panel 11 varies during a continuous operation. On the other hand, an electrical conductivity of the material of the common electrode 111 is poor. These results a voltage drift phenomenon of the common voltage on the common electrode 111. The voltage drift phenomenon produces flickering and/or viscid images. Therefore, the display performance of the LCD 10 is poor.

What is needed, therefore, is an LCD device that can overcome the above-described deficiencies. What is also needed is a method for driving the LCD device.

DETAILED DESCRIPTION

Reference will now be made to the drawings to describe various embodiments of the present disclosure in detail.

Figure 1:
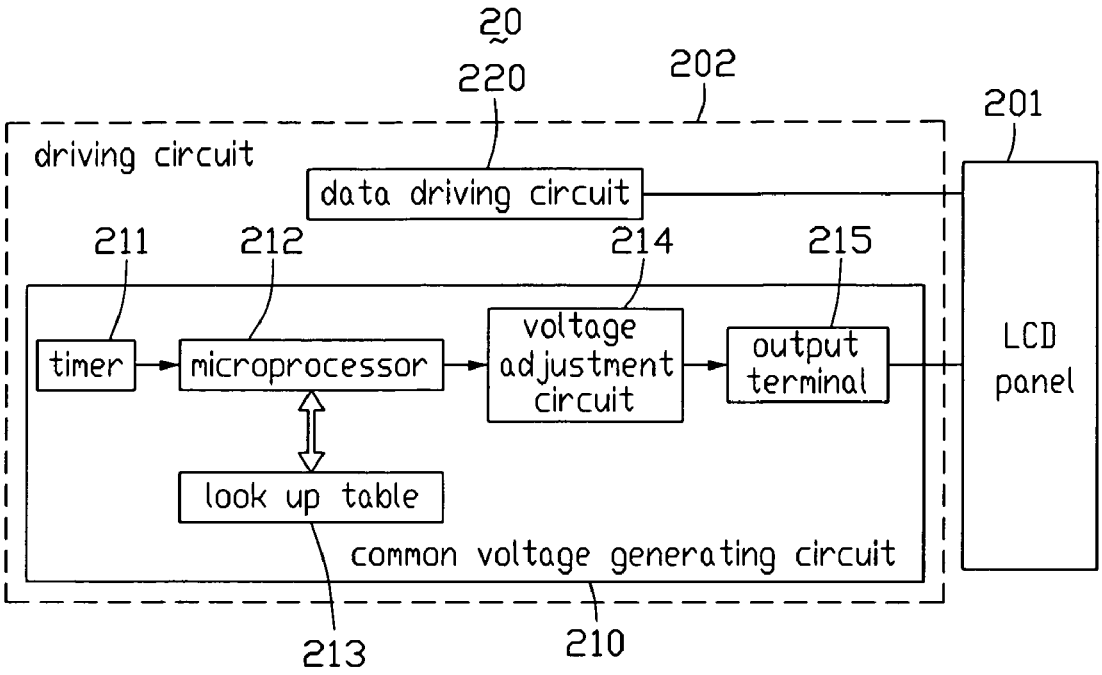
FIG. 1 is a block diagram of an LCD device according to a first embodiment of the present disclosure.

FIG. 1 is a block diagram of an LCD device according to a first embodiment of the present disclosure. The LCD device 20 includes an LCD panel 201 and a driving circuit 202. The driving circuit 202 includes a common voltage generating circuit 210 and a data driving circuit 220. The common voltage generating circuit 210 provides common voltages to a common electrode of the LCD panel 201. The data driving circuit 220 provides gray level voltages to pixel electrodes of the LCD panel 201. A voltage difference formed between the common voltages and the gray level voltages generates electric fields to drive liquid crystal molecules of the LCD panel 201.

The common voltage generating circuit 210 includes a timer 211, a microprocessor 212, a look up table 213, a voltage adjustment circuit 214, and a buffer, labeled as an output terminal 215. The microprocessor 212 is electrically connected to the timer 211, the look up table 213, and the voltage adjustment circuit 214. The output terminal 215 is electrically connected to the voltage adjustment circuit 214 and the LCD panel 201.

When the LCD device 20 is powered on, the timer 211 starts tracking a continuous operated time T of the LCD panel 201, and sends the continuous operated time T to the microprocessor 212 at a predetermined time interval, for example, every half hour. When the LCD device 20 is powered off, the recorded continuous operated time T resets to zero. The microprocessor 212 outputs adjustment pulse width modulation (PWM) signals to the voltage adjustment circuit 214 according to the continuous operated time T. The voltage adjustment circuit 214 is a PWM switching power circuit, which generates the common voltages according to the adjustment PWM signals from the microprocessor 212. Then the common voltages are provided to the LCD panel 201 via the output terminal 215.

A number of optimal common voltages are recorded in the look up table 213 corresponding to the continuous operated time T. The optimal common voltages are obtained during a test process of the LCD device 20 as follows.

In a step A, a first optimal common voltage is recorded at a time TO right when the LCD device 20 is powered on. That is, the continuous operated time T0 is equal to zero. A predetermined effective common voltage is supposed to be V To get the effective common voltage V at the time T0, the common voltage generating circuit 210 outputs a common voltage V0. The common voltage V0 and the corresponding time T0 are recorded in the look up table 213. The common voltage V0 is defined as the optimal common voltage of the LCD device 20 at the time T0.

In a step B, a second optimal common voltage is recorded after the LCD device 20 has continuously operated for a predetermined interval T1. At the time T1, the effective common voltage V of the LCD device 20 is measured to determine whether the effective common voltage V deviated from a predetermined parameter.

If the effective common voltage V has not changed, a common voltage V1 and the time T1 are recorded in the look up table 213. The common voltage V1 corresponds to the time T1, and the value of the common voltage V1 is equal to that of the common voltage V0. That is, the common voltage V1 is equal to the optimal common voltage of the LCD device 20 at the time T1.

If the effective common voltage V changes, an output voltage of the common voltage generating circuit 210 is adjusted to keep the effective common voltage V constant. The output voltage of the common voltage generating circuit 210 is V1, which is an optimal common voltage of the LCD device 20 at the time T1. The common voltage V1 and the time T1 are recorded in the look up table 213.

The step B is repeated, and optimal common voltages V2, V3, V4 . . . corresponding to the time T2, T3, T4 . . . are respectively recorded in the look up table 213. T2, T3, T4 . . . are continuous operated intervals of the LCD device 20 after T1. The latter interval Tn+1 is longer than the former interval Tn (n is a natural number).

Figure 2:
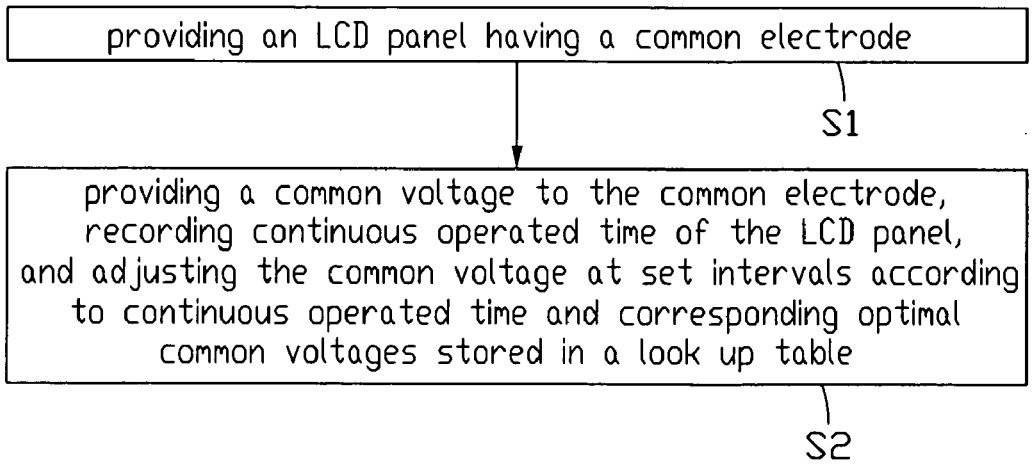
FIG. 2 is a flowchart illustrating an exemplary method for driving the LCD device of FIG. 1.

FIG. 2 is a flowchart summarizing an exemplary method for driving the LCD device 20. The driving method includes: step S1, providing an LCD panel having a common electrode; and step S2, providing a common voltage to the common electrode, recording continuous operated time of the LCD panel, and adjusting the common voltage at set intervals according to the continuous operated time and the corresponding optimal common voltages stored in a look up table.

When the LCD device 20 is powered on, the timer 211 sends the time T0 to the microprocessor 212. The microprocessor 212 reads a first optimal common voltage V0 corresponding to the time T0 from the look up table 213. The microprocessor 212 outputs the adjustment PWM signal to the voltage adjustment circuit 214 according to the first optimal common voltage V0. The adjustment PWM signal control the voltage adjustment circuit 214 to provide the optimal common voltage V0 to the LCD panel 201 via the output terminal 215.

When the LCD device 20 is working for a continuous time T1, for example, T1=10 minutes, the timer 211 sends the time T1 to the microprocessor 212. The microprocessor 212 reads a second optimal common voltage V1 corresponding to the time T1 from the look up table 213. The microprocessor 212 provides another adjustment PWM signal to the voltage adjustment circuit 214 according to the second optimal common voltage V1. The voltage adjustment circuit 214 provides the optimal common voltage V1 to the LCD panel 201 via the output terminal 215 under the control of another adjustment PWM signal.

When the LCD device 20 is working for a continuous time T2, for example, T2=20 minutes, the common voltage generating circuit 210 provides a third optimal common voltage V2 to the LCD panel 201 according to the look up table 213. At set intervals T3, T4 . . . the common voltage generating circuit 210 generates corresponding optimal common voltages V3, V4 . . . according to the look up table 213, thereby adjusting the effective common voltages applied to the LCD panel 201.

The effective common voltage can be modified according to the continuous operated time and corresponding optimal common voltages stored in the look up table 213. A common voltage drift is avoided. Thus, image flickering is prevented. The LCD device 20 has a stable performance.

Figure 3:
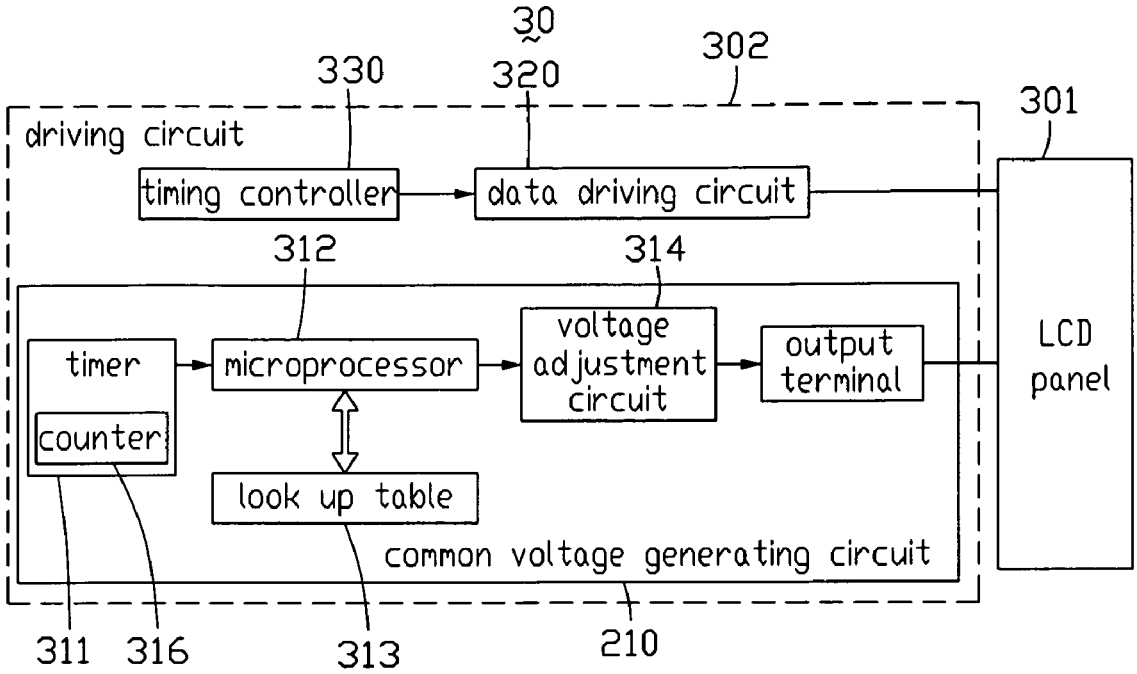
FIG. 3 is a block diagram of an LCD device according to a second embodiment of the present disclosure.
Figure 4:
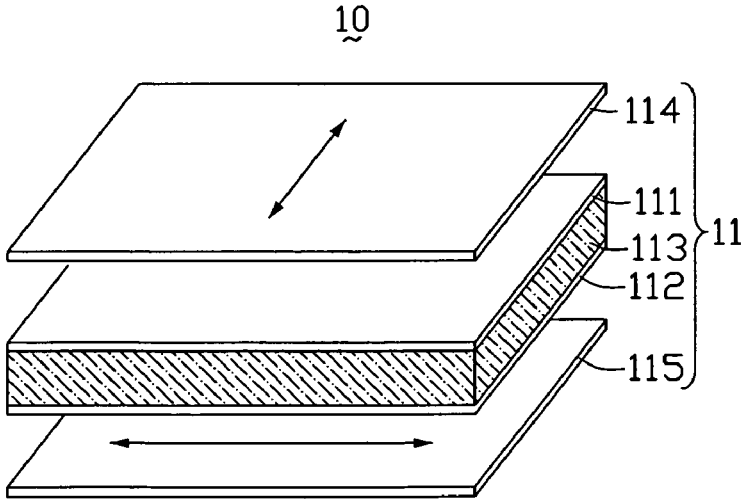
FIG. 4 (RELATED ART)
FIG. 4 is an isometric view of a conventional LCD.

FIG. 3 shows a block diagram of an LCD device according to a second embodiment of the present disclosure. The LCD device 30 is generally similar to the LCD device 20 except that the driving circuit 302 further includes a timing controller 330, and the timer 311 further includes a counter 316. The timing controller 330 provides clock signals to a data driving circuit 320 and a timer 311. The clock signal has a period Ta. An initial counter value X of the counter 316 is set to zero. At each time when a voltage level of the clock signal changes from a high level to a low level, the recording value X increases by one. When the recording value X reaches a predetermined value, for example, X=10000, the counter 316 sends the recording value X to a microprocessor 312. The microprocessor 312 calculates continuous operated time T of the LCD device 30, by the formula: T=X*Ta. Then the microprocessor 312 reads out an optimal common voltage corresponding to the continuous operated time T in a look up table 313. A voltage adjustment circuit 314 provides the optimal common voltage to the LCD panel 301 under the control of the microprocessor 312.

Unlike the LCD device 20, the counter 316 counts a number of the clock signals. The continuous operated time T of the LCD device 30 is calculated by the microprocessor 312 according to a counting value of the counter 316. The LCD device 30 can achieve the advantages similar to that of the LCD device 20.

In further and/or alternative embodiments, the voltage adjustment circuit 214 of the LCD device 20 may be a pulse frequency modulation switching power circuit.

It is to be understood that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A liquid crystal display (LCD) device, comprising:
an LCD panel; and
a common voltage generating circuit that provides common voltages to the LCD panel, the common voltage generating circuit comprising:
a timer configured for recording a current continuous operated time of the LCD panel;
a voltage adjustment circuit configured for modifying the common voltages of the LCD panel;
a look up table configured for storing a plurality of preset voltage values, wherein each of the preset voltage values is corresponded to one of a plurality of preset continuous operated times; and
a microprocessor being electrically connected to the timer, the look up table, and the voltage adjustment circuit;
wherein the microprocessor is configured for periodically reading one of the preset voltage values which is corresponded to the preset continuous operated time matching the current continuous operated time, and controlling the voltage adjustment circuit to modify the common voltage outputted to the LCD panel according to the preset voltage value corresponded to the preset continuous operated time matching the current continuous operated time.

2. The LCD device of claim 1, wherein the common voltage generating circuit further comprises a buffer for outputting the modified common voltages, the voltage adjustment circuit providing the modified common voltages to the LCD panel via the buffer.

3. The LCD device of claim 2, further comprising a data driving circuit, the data driving circuit providing gray level voltages to the LCD panel.

4. The LCD device of claim 3, wherein the voltage adjustment circuit is a pulse width modulation mode switching power circuit.

5. The LCD device of claim 3, wherein the voltage adjustment circuit is a pulse frequency modulation mode switching power circuit.

6. The LCD device of claim 4, further comprising a timing controller configured for generating clock signals, the timer comprising a counter configured for counting a number of the clock signals to calculate the current continuous operated time of the LCD panel.

7. A method for driving a liquid crystal display (LCD) device, the method comprising:

(1) providing an LCD panel having a common electrode, and (2) providing a common voltage generating circuit configured for applying common voltages to the common electrode;

(3) providing a common voltage to the common electrode, and adjusting the common voltage at set intervals according to a current continuous operated time of the LCD panel;

wherein the common voltage generating circuit comprises:

a timer configured for recording the current continuous operated time of the LCD panel;

a voltage adjustment circuit configured for modifying the common voltage of the LCD panel;

a look up table configured for storing a plurality of preset voltage values, wherein each of the preset voltage values is corresponded to one of a plurality of preset continuous operated times; and a microprocessor configured for periodically reading one of the preset voltage values which is corresponded to the preset continuous operated time matching the current continuous operated time, and controlling the voltage adjustment circuit to modify the common voltage outputted to the LCD panel according to the preset voltage value corresponded to the preset continuous operated time matching the current continuous operated time.

8. The method of claim 7, further comprising:

resetting the timer to zero out the current continuous operated time at start up and shutdown of the LCD panel.

9. The method of claim 8, wherein the common voltage is modified at set intervals of ten minutes.

10. A liquid crystal display (LCD) device, comprising:

an LCD panel; and a common voltage generating circuit configured for providing common voltages to the LCD panel, the common voltage generating circuit comprising:

a look up table configured for storing a plurality of preset voltage values, wherein each of the preset voltage values is corresponded to one of a plurality of preset continuous operated times;

wherein the common voltage generating circuit modify the common voltage outputted to the LCD panel according to the preset voltage value corresponded to the preset continuous operated time matching a current continuous operated time.

11. The LCD device of claim 10, further comprising a timer configured for recording the current continuous operated time of the LCD panel.

12. The LCD device of claim 11, further comprising a timing controller, the timing controller generating clock signals, the timer further comprising a counter configured for counting a number of the clock signals to calculate the current continuous operated time of the LCD panel.

* * * * *